US011105544B2

(12) United States Patent
Cosby, II et al.

(10) Patent No.: US 11,105,544 B2
(45) Date of Patent: Aug. 31, 2021

(54) VARIABLE ORIFICE FOR A CHILLER

(71) Applicant: TRANE INTERNATIONAL INC., Davidson, NC (US)

(72) Inventors: Ronald Maurice Cosby, II, La Crosse, WI (US); Brian T. Sullivan, La Crosse, WI (US); Steven J. Pitts, La Crescent, MN (US); Thomas Gallant, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 483 days.

(21) Appl. No.: 15/344,974

(22) Filed: Nov. 7, 2016

(65) Prior Publication Data

US 2018/0128527 A1 May 10, 2018

(51) Int. Cl.
*F25B 41/30* (2021.01)
*F25B 41/20* (2021.01)
(Continued)

(52) U.S. Cl.
CPC ..... *F25B 41/30* (2021.01); *F25B 1/00* (2013.01); *F25B 41/20* (2021.01); *F25B 41/39* (2021.01);
(Continued)

(58) Field of Classification Search
CPC ..... F25B 41/04; F25B 41/06–067; F25B 41/043; F25B 43/006; F25B 2341/0662;
(Continued)

(56) References Cited

U.S. PATENT DOCUMENTS 3,864,938 A * 2/1975 Hayes, Jr. ..... F25B 41/06 137/14
4,843,838 A * 7/1989 Trask ..... F25B 13/00 62/324.6
(Continued)

FOREIGN PATENT DOCUMENTS

AU 2014200096 A1 1/2014
CN 1358978 A 7/2002
(Continued)

OTHER PUBLICATIONS

Office Action, Chinese Patent Application No. 201711086389.6, dated Oct. 9, 2020, with partial English translation (13 pages).
(Continued)

*Primary Examiner* — Jianying C Atkisson
*Assistant Examiner* — Miguel A Diaz
(74) *Attorney, Agent, or Firm* — Hamre, Schumann, Mueller & Larson, P.C.

(57) ABSTRACT

A refrigerant circuit is disclosed. The refrigerant circuit includes a compressor, a condenser, a first expansion device, an economizer, a second expansion device, and an evaporator fluidly connected. A working fluid flows through the refrigerant circuit. A bypass segment is fluidly connected to the refrigerant circuit. A portion of the working fluid is provided from the refrigerant circuit to the bypass segment from a location in the refrigerant circuit disposed between the condenser and the evaporator with respect to flow of the working fluid. The portion of the working fluid flows through the bypass segment in a flow enabled state and is provided to a location in the refrigerant circuit disposed between the economizer and the evaporator with respect to flow of the working fluid. A vortical flow is induced at the location in the refrigerant circuit disposed between the economizer and the evaporator.

19 Claims, 6 Drawing Sheets

(51) Int. Cl.
*F25B 1/00* (2006.01)
*F25B 41/39* (2021.01)

(52) U.S. Cl.
CPC ... *F25B 2400/13* (2013.01); *F25B 2600/2501* (2013.01)

(58) Field of Classification Search
CPC ..... F25B 2400/04; F25B 2400/13; F25B 2400/0415; F25B 2600/2501; F25B 2600/2503; F25B 2600/2509
See application file for complete search history.

(56) References Cited

U.S. PATENT DOCUMENTS 5,372,013 A 12/1994 Lau et al.
5,655,379 A * 8/1997 Jaster ..... F25B 41/065 137/392
5,806,327 A * 9/1998 Lord ..... F25B 41/062 62/115
6,460,357 B1 * 10/2002 Doi ..... F25B 1/10 62/199
6,857,287 B1 * 2/2005 Alsenz ..... F25B 1/00 62/45.1
8,966,916 B2 * 3/2015 Deaconu ..... F25B 1/10 62/115
2002/0069654 A1 6/2002 Doi et al.
2002/0078698 A1 * 6/2002 Leisenheimer ..... B60H 1/3217 62/132
2003/0200763 A1 * 10/2003 Takeuchi ..... B60H 1/00921 62/324.6
2003/0200764 A1 * 10/2003 Takeuchi ..... F25B 13/00 62/500
2003/0209026 A1 * 11/2003 Sakuma ..... F25B 13/00 62/324.1
2003/0226370 A1 * 12/2003 Tanimoto ..... F25B 13/00 62/259.2
2004/0206110 A1 * 10/2004 Lifson ..... F25B 1/10 62/498
2006/0096308 A1 5/2006 Manole
2006/0107671 A1 * 5/2006 Yoshida ..... F25B 47/022 62/151
2011/0005270 A1 * 1/2011 Yoshimi ..... F25B 13/00 62/510
2011/0030409 A1 * 2/2011 Fujimoto ..... F25B 1/10 62/324.6
2012/0227426 A1 9/2012 Deaconu
2014/0033741 A1 * 2/2014 Song ..... F25B 45/00 62/77
2014/0230477 A1 * 8/2014 Furui ..... F24D 3/082 62/238.6
2014/0298849 A1 * 10/2014 Alpha ..... F25B 41/003 62/404
2015/0151609 A1 * 6/2015 Satou ..... B60H 1/3204 165/63
2015/0176866 A1 * 6/2015 Takayama ..... F25B 5/04 62/140
2016/0096629 A1 4/2016 Vaisman
2016/0236538 A1 * 8/2016 Suzuki ..... B60H 1/00921
2016/0280041 A1 * 9/2016 Suzuki ..... B60H 1/00921
2017/0115043 A1 * 4/2017 Laughman ..... F25B 13/00
2017/0159982 A1 * 6/2017 West ..... F25B 49/02
2018/0128527 A1 * 5/2018 Cosby, II ..... F25B 1/00
2019/0011154 A1 * 1/2019 Takizawa ..... B60H 1/3213
2019/0203993 A1 * 7/2019 Lesmerises ..... F25B 1/10
2019/0368754 A1 * 12/2019 Blanton ..... F25B 41/003
2020/0149751 A1 * 5/2020 Cho ..... F25B 13/00
2020/0363102 A1 * 11/2020 Zha ..... F25B 7/00
2020/0370809 A1 * 11/2020 Mahmoud ..... F25B 41/26

FOREIGN PATENT DOCUMENTS

CN 1405515 A 3/2003
CN 1149373 C 5/2004
CN 1854648 A 11/2006
CN 101061338 A 10/2007
CN 102062497 A 5/2011
CN 103868264 A 6/2014
CN 105579259 A 5/2016
CN 105972717 A 9/2016
EP 3710349 A1 5/1996
EP 2592368 A2 * 5/2013 ..... F25B 41/04
GN 1151008 A 6/1997
GN 105393067 A 3/2016
JP H08313121 A 11/1996
JP 2015017773 A 1/2015

OTHER PUBLICATIONS

Office Action, Chinese Patent Application No. 201711086389 6, dated May 27, 2021, with partial English translation (9 pages).

* cited by examiner

VARIABLE ORIFICE FOR A CHILLER

FIELD

This disclosure relates to a heating, ventilation, air conditioning, and refrigeration (HVACR) system. More specifically, this disclosure relates to an expansion device in an HVACR system.

BACKGROUND

A heating, ventilation, air conditioning, and refrigeration (HVACR) system can include a refrigerant circuit having a compressor, a condenser, an expansion device, an economizer, and an evaporator fluidly connected. The expansion device, or in some cases, expansion devices, can be used to reduce a pressure of the fluid in the refrigerant circuit. A chiller unit can be included in an HVACR system. The expansion device(s) in the chiller unit can be a single or double orifice plate. Reduction of pressure in the chiller unit can be performed via the single or double orifice plate.

SUMMARY

A heating, ventilation, air conditioning, and refrigeration (HVACR) system including a refrigerant circuit is disclosed. The refrigerant circuit includes a compressor, a condenser, a plurality of expansion devices, an economizer, and an evaporator, fluidly connected via a plurality of conduits. In an embodiment, the plurality of expansion devices includes single or double orifice plates.

In an embodiment, the refrigerant circuit includes a bypass segment. The bypass segment can include one or more conduits and a flow control device.

A refrigerant circuit is described. The refrigerant circuit includes a compressor, a condenser, a first expansion device, an economizer, a second expansion device, and an evaporator fluidly connected. A working fluid flows through the refrigerant circuit. A bypass segment of the refrigerant circuit fluidly connected to the refrigerant circuit. A portion of the working fluid is provided from the refrigerant circuit to the bypass segment. The portion of the working fluid is provided from a location in the refrigerant circuit disposed between the condenser and the evaporator with respect to flow of the working fluid. The portion of the working fluid flows through the bypass segment in a flow enabled state and is provided to a location in the refrigerant circuit disposed between the economizer and the evaporator with respect to flow of the working fluid. A vortical flow is induced at the location in the refrigerant circuit disposed between the economizer and the evaporator based on merging of the working fluid and the portion of the working fluid.

A chiller unit for a heating, ventilation, air conditioning, and refrigeration (HVACR) system is described. The chiller unit includes a refrigerant circuit. The refrigerant circuit includes a compressor, a condenser, a first expansion device, an economizer, a second expansion device, and an evaporator fluidly connected. A working fluid flows through the refrigerant circuit. A bypass segment of the refrigerant circuit fluidly connected to the refrigerant circuit. A portion of the working fluid is provided from the refrigerant circuit to the bypass segment. The portion of the working fluid is provided from a location in the refrigerant circuit disposed between the condenser and the evaporator with respect to flow of the working fluid. The portion of the working fluid flows through the bypass segment in a flow enabled state and is provided to a location in the refrigerant circuit disposed between the economizer and the evaporator with respect to flow of the working fluid. A vortical flow is induced at the location in the refrigerant circuit disposed between the economizer and the evaporator.

A method is described. The method includes compressing a working fluid with a compressor; directing the working fluid from the compressor to a condenser; directing the working fluid from the condenser to an evaporator; diverting a portion of the working fluid from the condenser to a bypass conduit, the bypass conduit having an inlet disposed between the condenser and the evaporator, and the bypass conduit having an outlet disposed between the condenser and the evaporator, the outlet being relatively closer to the evaporator than the inlet; and inducing a vortical flow in the working fluid at the outlet of the bypass conduit by rejoining the portion of the working fluid with the working fluid from the condenser to the evaporator.

BRIEF DESCRIPTION OF THE DRAWINGS

Reference is made to the accompanying drawings that form a part of this disclosure, and which illustrate embodiments in which the systems and methods described in this specification can be practiced.

Like reference numbers represent like parts throughout.

DETAILED DESCRIPTION

Generally, heating, ventilation, air conditioning, and refrigeration (HVACR) systems include one or more expansion devices which can be included in a refrigerant circuit of the HVACR system. For example, an expansion device can be disposed between a condenser and an economizer in the refrigerant circuit, between the economizer and an evaporator, or the like. In some HVACR systems, the one or more expansion devices can be a single or double orifice plate. Sizing of the orifice(s) for the plate may be optimized to certain operational conditions, but not optimal for other operational conditions. Providing a variable orifice to address this issue can increase a complexity of the system by including large valve systems. These systems are often expensive, and in addition to increasing a complexity of the system, can increase an overall cost of the system. Simpler, lower cost alternatives are desirable.

Embodiments described in this specification include addition of a flow modification circuit within a refrigerant circuit of an HVACR system having an orifice plate (a single plate or a plurality of plates including one or more apertures) type of device. The flow modification circuit can be employed within a refrigerant circuit of an HVACR system that includes an expansion device other than an orifice plate type of device. The flow modification circuit can be used to divert a portion of working fluid from a primary flow of working fluid in the refrigerant circuit and merge the diverted portion of the working fluid with the primary flow of the working fluid in the refrigerant circuit at a location downstream of the diversion. Merging the working fluid with the primary flow of the working fluid in the refrigerant circuit can create a vortex in the primary flow of the working fluid. The flow of the working fluid about the vortex may be referred to as "vortical flow." Further, the vortical flow can alternatively be referred to as turbulent flow. It will be appreciated that the creation of a vortex or vortical flow can result in turbulent flow of the working fluid. The merging of the diverted portion of the working fluid with the primary flow of working fluid can be such that a flow direction of the diverted portion of the working fluid is not parallel to the primary flow of the working fluid through the refrigerant circuit. In an embodiment, the vortex can lower a static pressure within the flow of the working fluid in the refrigerant circuit. In an embodiment, this can cause a liquid portion of the working fluid to flash (e.g., convert from a liquid state to a gaseous state).

Figure 1:
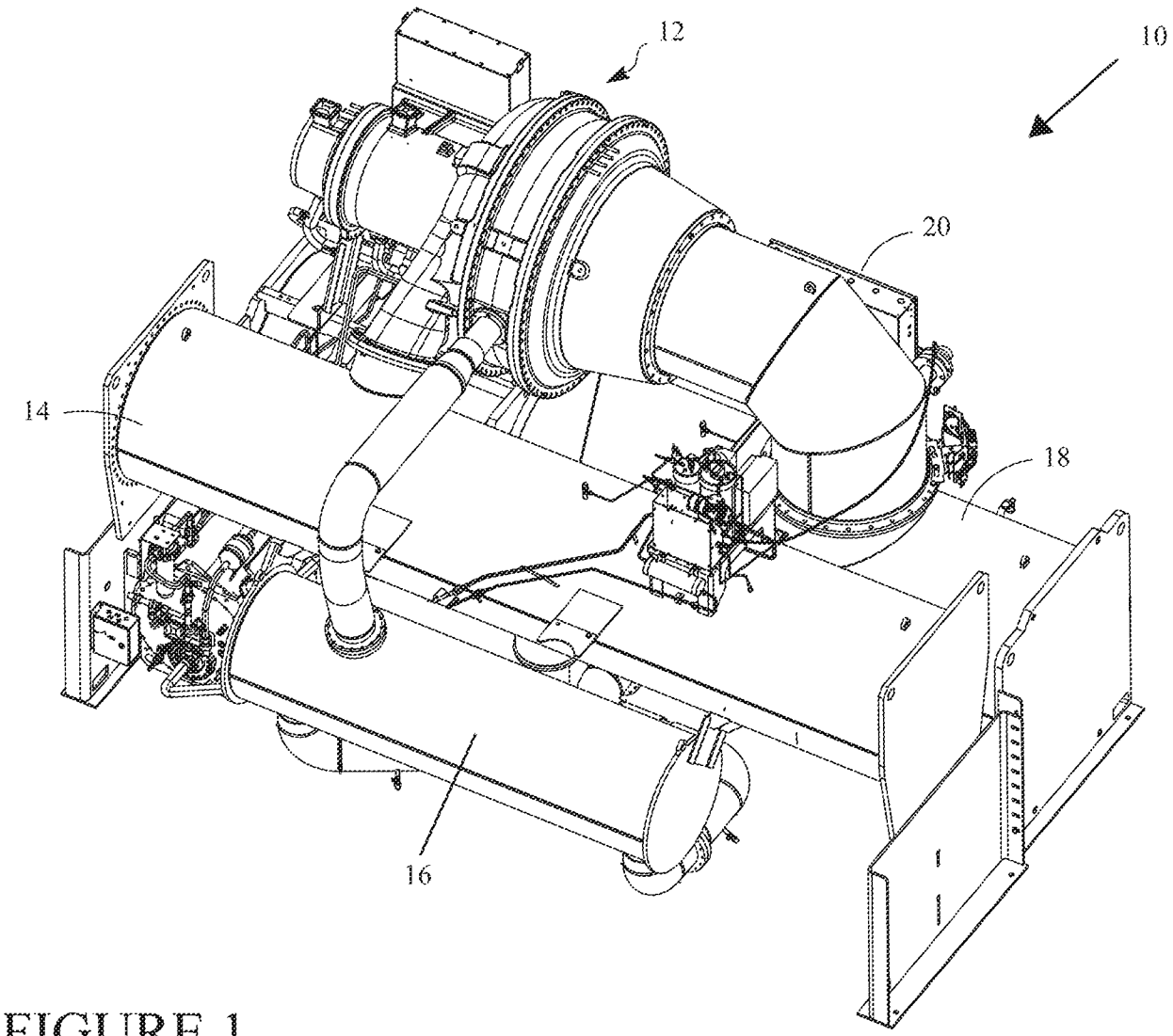
FIG. 1 is a perspective view of a chiller unit of a heating, ventilation, air conditioning, and refrigeration (HVACR) system, according to an embodiment.

FIG. 1 is a perspective view of a chiller unit 10 of an HVACR system, according to an embodiment. The chiller unit 10 is an example system in which embodiments and methods described in this specification can be practiced. It will be appreciated that aspects of the chiller unit 10 may be modified, but within the scope of embodiments described in this specification.

The chiller unit 10 includes, among other features, a compressor 12 fluidly connected to a condenser 14, which is fluidly connected to an economizer 18 and an evaporator 22. The fluidly connected components, for example, may form a refrigerant circuit. In an embodiment, a fluid used in the refrigerant circuit (e.g., a working fluid) can be a heat transfer fluid or medium such as a refrigerant or the like which is in a heat exchange relationship with one or more heat transfer fluids or media (e.g., a process fluid) such as, but not limited to, water, etc., to cool or chill the process fluid for other use or applications such as, but not limited to, a comfort cooling application or the like. A control system 20 may control an operation of the chiller unit 10. It will be appreciated that the chiller unit 10 and/or the refrigerant circuit for the chiller unit 10 can include one or more additional features. For example, one or more expansion devices (e.g., expansion devices 32, 34 in FIGS. 2-5 shown and described below) can be included in the chiller unit 10.

FIG. 2-5 are schematic diagrams of refrigerant circuits 22A-22D, according to an embodiment. Aspects of the refrigerant circuits 22A-22D may be the same as or similar to each other. For simplicity of this specification, aspects of the refrigerant circuits 22B-22D which are the same as or similar to aspects of the refrigerant circuit 22A may not be described in additional detail.

The refrigerant circuits 22A-22D generally include a compressor 24, condenser 26, economizer 28, and evaporator 30 fluidly connected to form a closed circuit. The compressor 24 can be, for example, a scroll compressor, a screw compressor, a centrifugal compressor, a reciprocating compressor, a toroidal compressor, or the like. The compressor 24, condenser 26, economizer 28, and evaporator 30 may correspond to the compressor 12, the condenser 14, the economizer 16, and the evaporator 18 (respectively) in FIG. 1, according to an embodiment. The refrigerant circuits 22A-22D can be modified to include one or more additional components such as, but not limited to, one or more additional flow control devices, a receiver tank, a dryer, a suction-liquid heat exchanger, or the like. The refrigerant circuits 22A-22D can be modified to include fewer components. For example, in an embodiment the economizer 28 may not be included in the refrigerant circuits 22A-22D. In an embodiment, the refrigerant circuits 22A-22D can be employed in a system other than the chiller unit 10 in FIG. 1. For example, the refrigerant circuits 22A-22D can be employed in a rooftop unit, a water source heat pump, a residential air conditioning unit, or the like.

The refrigerant circuits 22A-22D can generally be applied in a variety of systems used to control an environmental condition (e.g., temperature, humidity, air quality, or the like) in a space (generally referred to as a conditioned space). Examples of such systems include, but are not limited to, the chiller unit 10 shown and described in accordance with FIG. 1 above.

The components of the refrigerant circuits 22A-22D are fluidly connected. The refrigerant circuits 22A-22D can be specifically configured to be a cooling system (e.g., an air conditioning system) capable of operating in a cooling mode. Alternatively, the refrigerant circuits 22A-22D can be specifically configured to be a heat pump system which is capable of operating in both a cooling mode and a heating/defrost mode.

The refrigerant circuits 22A-22D can be configured to heat or cool a heat transfer fluid or medium (e.g., a liquid such as, but not limited to, water or the like), in which case the refrigerant circuits 22A-22D may be representative of a liquid chiller system. The heat transfer fluid or medium being heated or cooled in such an embodiment may be referred to as a process fluid.

In operation, the compressor 24 compresses a heat transfer fluid or medium (e.g., a refrigerant or the like) from a relatively low pressure gas to a relatively higher-pressure gas. The heat transfer fluid or medium may be referred to as a working fluid. The working fluid which is a relatively higher-pressure and higher temperature gas is discharged from the compressor 24 and flows to the condenser 26 via a conduit 36. In accordance with generally known principles, the working fluid flows through the condenser 14 and rejects heat to the process fluid, thereby cooling the working fluid. The cooled working fluid, which is now in a liquid form, flows to an expansion device 32 via a conduit 38. The expansion device 32 reduces a pressure of the working fluid. As a result, a portion of the working fluid is converted to a gaseous form. The working fluid, which is in a mixed liquid and gaseous form, flows to the economizer 28 via a conduit 40. At the economizer 28, a gaseous portion of the working fluid (which is in a mixed liquid and gaseous form) flows from the economizer 28 to the compressor 24 via a conduit 48. A liquid portion of the working fluid (which is in a mixed liquid and gaseous form) flows from the economizer 28 to an expansion device 34 via a conduit 42. In an embodiment, the refrigerant circuits 22A-22D can include both the expansion devices 32, 34. In another embodiment, the refrigerant circuits 22A-22D can include one expansion device, such as expansion device 34 but not expansion device 32. The working fluid which is provided to the expansion device 34 can be at an intermediate pressure (e.g., a pressure of the working fluid that is between a suction pressure and a discharge pressure). The expansion device 34 reduces a pressure of the working fluid, which results in a portion of the working fluid being converted to a gaseous form. The working fluid, which is in a mixed gaseous and liquid form, flows to the evaporator 30 via a conduit 44. The working fluid flows through the evaporator 30 and absorbs heat from the process fluid, heating the working fluid, and converting it to a gaseous form. The working fluid, which is now in a gaseous form, then flows to the compressor 24 via a conduit 46. The above-described process generally continues while the refrigerant circuits 22A-22D are operating, for example, while the compressor 24 is enabled.

Figure 2:
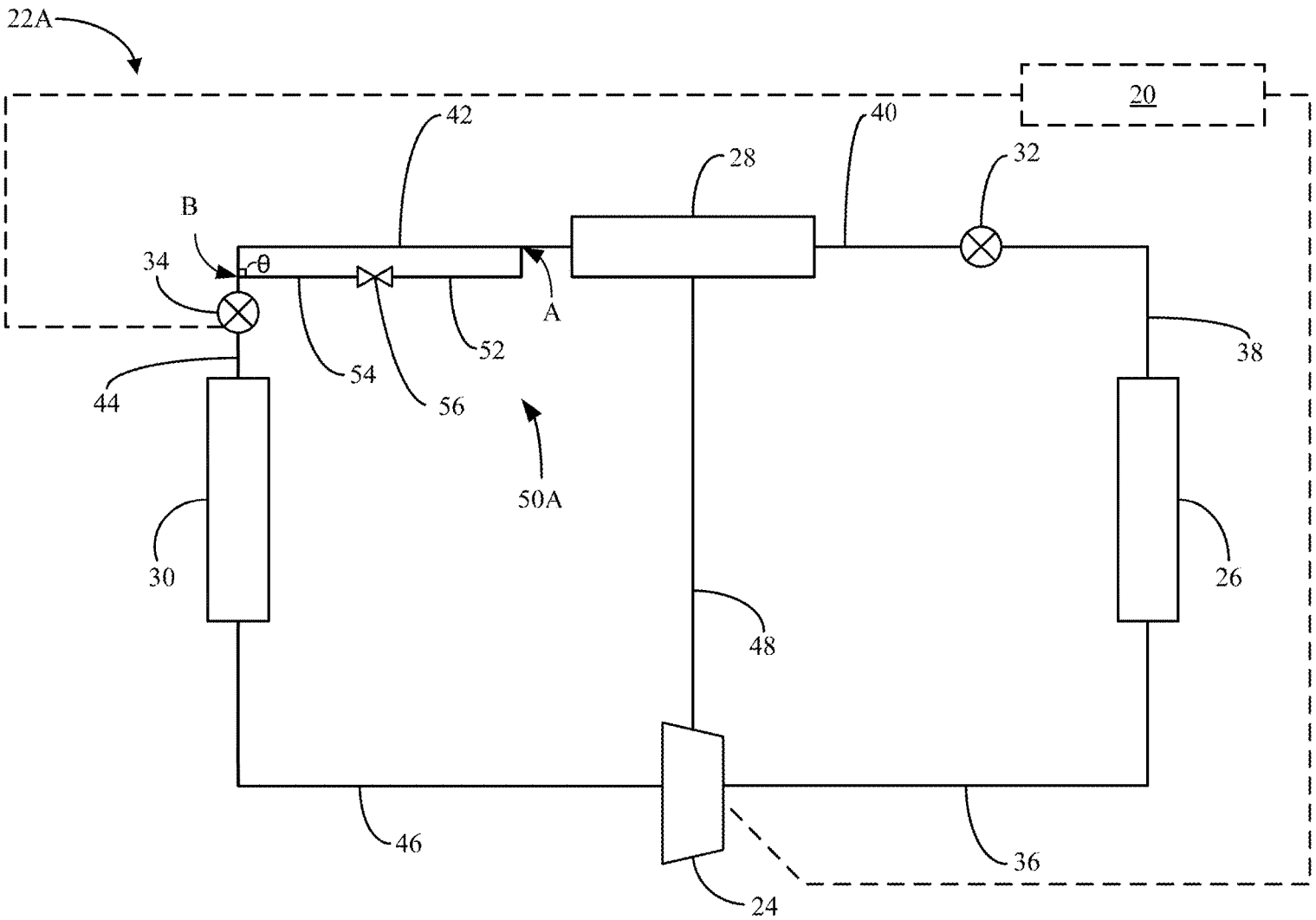
FIG. 2 is a schematic diagram of a refrigerant circuit, according to an embodiment.

The refrigerant circuit 22A in FIG. 2 includes a bypass segment 50A. In the illustrated embodiment, the bypass segment 50A includes conduits 52, 54 and a flow control device 56. The bypass segment 50A is fluidly connected to the conduit 42 at a location A, such that when the working fluid exits the economizer 28 and flows to the expansion device 34 via the conduit 42, a portion of the working fluid may be diverted into the bypass segment 50A via the conduit 52. A state of the flow control device 56 can determine whether the working fluid flows to the conduit 54 and is rejoined or merged with the flow of the working fluid through conduit 42 at a location B. In an embodiment, the flow control device 56 can have two states (e.g., flow enabled, flow disabled). In an embodiment, the flow control device 56 can have more than two states (e.g., flow enabled, flow disabled, flow partially enabled, etc.).

In an embodiment, the bypass segment 50A can be formed of a single conduit (composed of conduits 52, 54) and a single flow control device (flow control device 56). In an embodiment, the bypass segment 50A can include a plurality of conduits and a plurality of flow control devices.

The conduit 54 can be configured such that an angle θ is maintained between a longitudinal axis (e.g., an axis along a length of the conduit 54) of the conduit 54 and a longitudinal axis (e.g., an axis along a length of the conduit 42) of the conduit 42 at the location B. For example, in an embodiment, the angle θ between the longitudinal axis of the conduit 54 and the longitudinal axis of the conduit 42 may be at or about 90°. In such an embodiment, the conduit 54 is oriented about perpendicularly to the conduit 42. In an embodiment, the angle between the longitudinal axis of the conduit 54 and the longitudinal axis of the conduit 42 may be selected such that the conduit 54 is oriented other than perpendicular to the conduit 42 (e.g., the angle θ is greater than or less than 90°. The angle θ can be selected to control flow conditions (e.g., turbulence, creation of a vortex, etc.) of the working fluid. In general, a desired flow condition includes creation of a vortex. In the illustrated embodiment, the vortex is created in the flow of the working fluid at the location B which is disposed upstream of the expansion device 34 (e.g., prior to the working fluid flowing into the expansion device 34). It will be appreciated that the vortical flow may be induced at a different location than the location B illustrated in the schematic diagram of FIG. 2. For example, the joinder of the conduits 54 and 42 can be relatively nearer to the expansion device 34, relatively nearer to the economizer 28, or at or about equidistant from the expansion device 34 and the economizer 28. The location B of the joinder of the conduits 54 and 42 can be selected to provide a particular pressure drop in the working fluid prior to the working fluid reaching the expansion device 34. Similarly, the location A at which the conduit 52 is joined with the conduit 42 can be varied. For example, an inlet to the conduit 52 can be relatively nearer to the expansion device 34, relatively nearer to the economizer 28, or at or about equidistant from the expansion device 34 and the economizer 28. In an embodiment, the inlet to the conduit 52 can be at an outlet of the economizer 28. For example, the outlet from the economizer 28 can include two fluid paths, one fluid path being connected to conduit 42 and the other fluid path being connected to conduit 52.

In operation, the bypass segment 50A can advantageously cause a relatively lower static pressure within the working fluid flow and cause a portion of the working fluid to transition to a gaseous form prior to the pressure drop induced by the expansion device 34. In an embodiment, the merging of the bypass segment 50A (e.g., location B) can result in a pressure drop due to the merging of the working fluid flows. In an embodiment, the bypass segment 50A can result in, for example, a wider range of operating conditions at which the refrigerant circuit 22A (and accordingly the chiller unit (e.g., chiller unit 10 of FIG. 1)) can operate because of the additional pressure drop. In an embodiment, this can enable the refrigerant circuit 22A to maintain a pressure differential between the condenser 26 and the evaporator 30 when in an operating condition in which water temperature of the process fluid in the condenser 26 is relatively lower. These operating conditions may be, for example, when ambient temperatures are relatively cooler.

In an embodiment, the flow control device 56 can be, for example, a regulating valve (e.g., a stepper valve, an electronic expansion valve, etc.) or the like. In an embodiment, the flow control device 56 can be a single solenoid valve (or multiple solenoid valves if there are multiple conduits) or the like. The flow control device 56 can be electrically connected to the controller 20 to control operation of the flow control device 56. The controller 20 could, in an embodiment, enable or disable flow through the bypass segment 50A based on, for example, a condenser saturation temperature, an evaporator saturation temperature, a temperature lift (e.g., temperature differential), a pressure differential, a liquid level of the working fluid in the evaporator, a liquid level in the condenser, or suitable combinations thereof.

The conduits 52, 54 can be, for example, a pipe or the like. The conduits 52, 54 generally have a diameter that is relatively smaller than a diameter of the conduits 36, 38, 40, 42, 44, 46, and 48. The relatively smaller diameter is possible because a flowrate of the working fluid through the bypass segment 50A can be less than a flowrate of the working fluid through the conduits 36, 38, 40, 42, 44, 46, and 48. In an embodiment, the relatively smaller diameter conduits 52, 54 can be cheaper than including a conduit having a larger diameter. In an embodiment, the vortical flow can be induced because of a flowrate of the diverted portion of the working fluid through the conduits 52, 54 being different than a flowrate of the working fluid through the conduits 36, 38, 40, 42, 44, 46, and 48.

Figure 3:
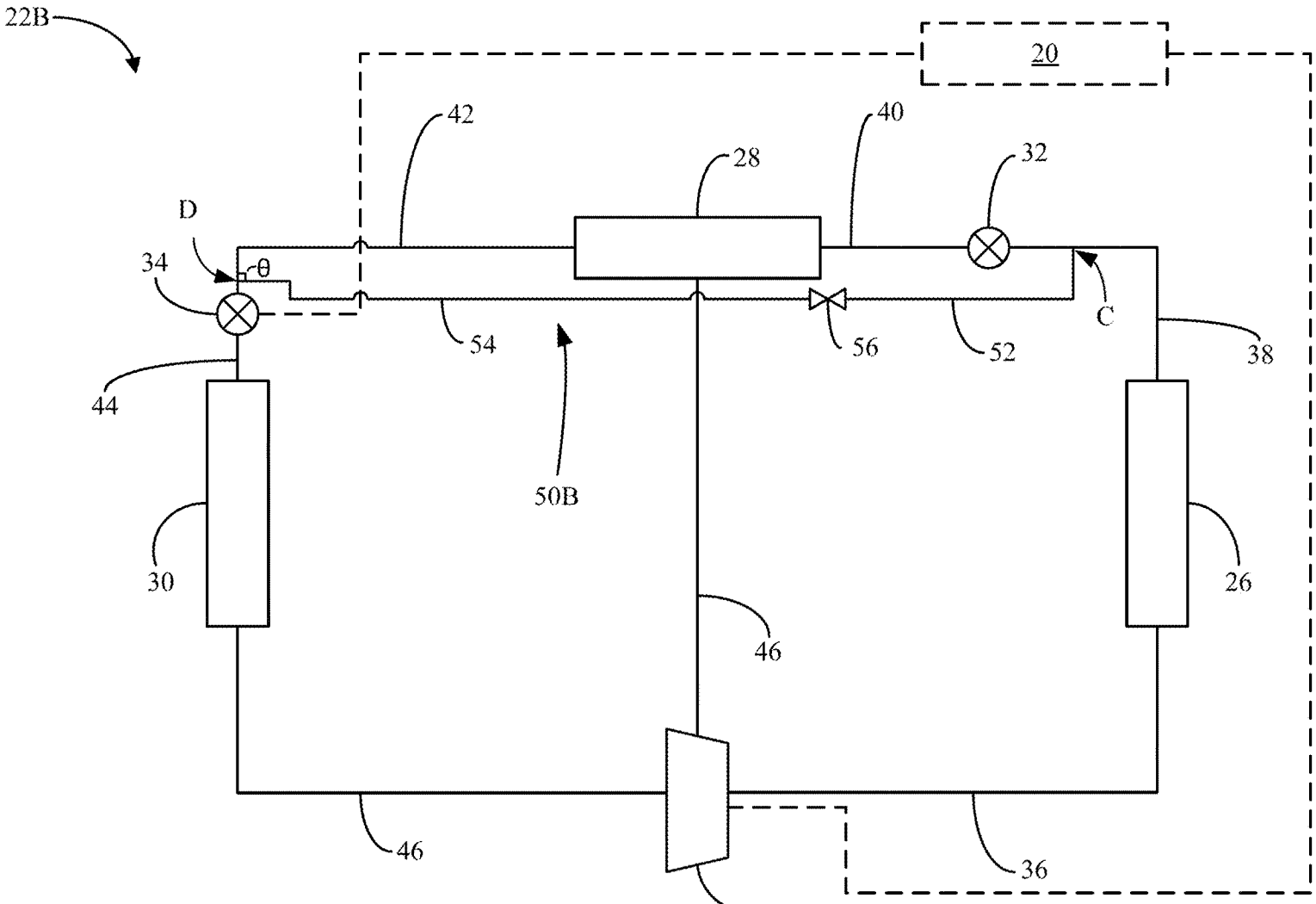
FIG. 3 is a schematic diagram of a refrigerant circuit, according to an embodiment.

The refrigerant circuit 22B in FIG. 3 includes a bypass segment 50B. In the illustrated embodiment, the bypass segment 50B includes the conduits 52, 54 and the flow control device 56. The bypass segment 50B can generally operate similarly to the bypass segment 50A. The bypass segment 50B is configured to receive working fluid at a different location C than the location A of the bypass segment 50A. The bypass segment 50B is fluidly connected to the conduit 38 at the location C, such that when the working fluid exits the condenser 26 and flows to the expansion device 32 via the conduit 38, a portion of the working fluid may be diverted into the bypass segment 50B via the conduit 52. A state of the flow control device 56 can determine whether the working fluid flows to the conduit 54 and is joined with the conduit 42. In an embodiment, the working fluid entering the bypass segment 50B can be at a relatively higher pressure than the working fluid entering the bypass segment 50A.

In the illustrated embodiment, the vortex is created in the flow of the working fluid at a location D before the working fluid flows into the expansion device 34. It will be appreciated that the vortical flow may be induced at a different location than the location D. For example, the joinder of the conduits 54 and 42 can be relatively nearer to the expansion device 34 in an embodiment, relatively nearer to the economizer 28, or at or about equidistant from the expansion device 34 and the economizer 28. The location of the joinder of the conduits 54 and 42 can be selected to provide a particular pressure drop in the working fluid prior to the working fluid reaching the expansion device 34. Similarly, the location C at which the conduit 52 is joined with the conduit 38 can be varied. For example, an inlet to the conduit 52 can be relatively nearer to the expansion device 32, relatively nearer to the condenser 26, or at or about equidistant from the expansion device 32 and the condenser 26.

In operation, the bypass segment 50B can advantageously cause a relatively lower static pressure within the working fluid flow and cause a portion of the working fluid to transition to a gaseous form prior to the pressure drop induced by the expansion device 34. In an embodiment, the bypass segment 50B can result in, for example, a wider range of conditions at which the refrigerant circuit 22B (and accordingly the chiller unit (e.g., chiller unit 10 of FIG. 1)) can operate because of the additional pressure drop. In an embodiment, this can enable the refrigerant circuit 22B to maintain a pressure differential between the condenser 26 and the evaporator 30 when in an operating condition in which water temperature of the process fluid in the condenser 26 are relatively lower.

Figure 4:
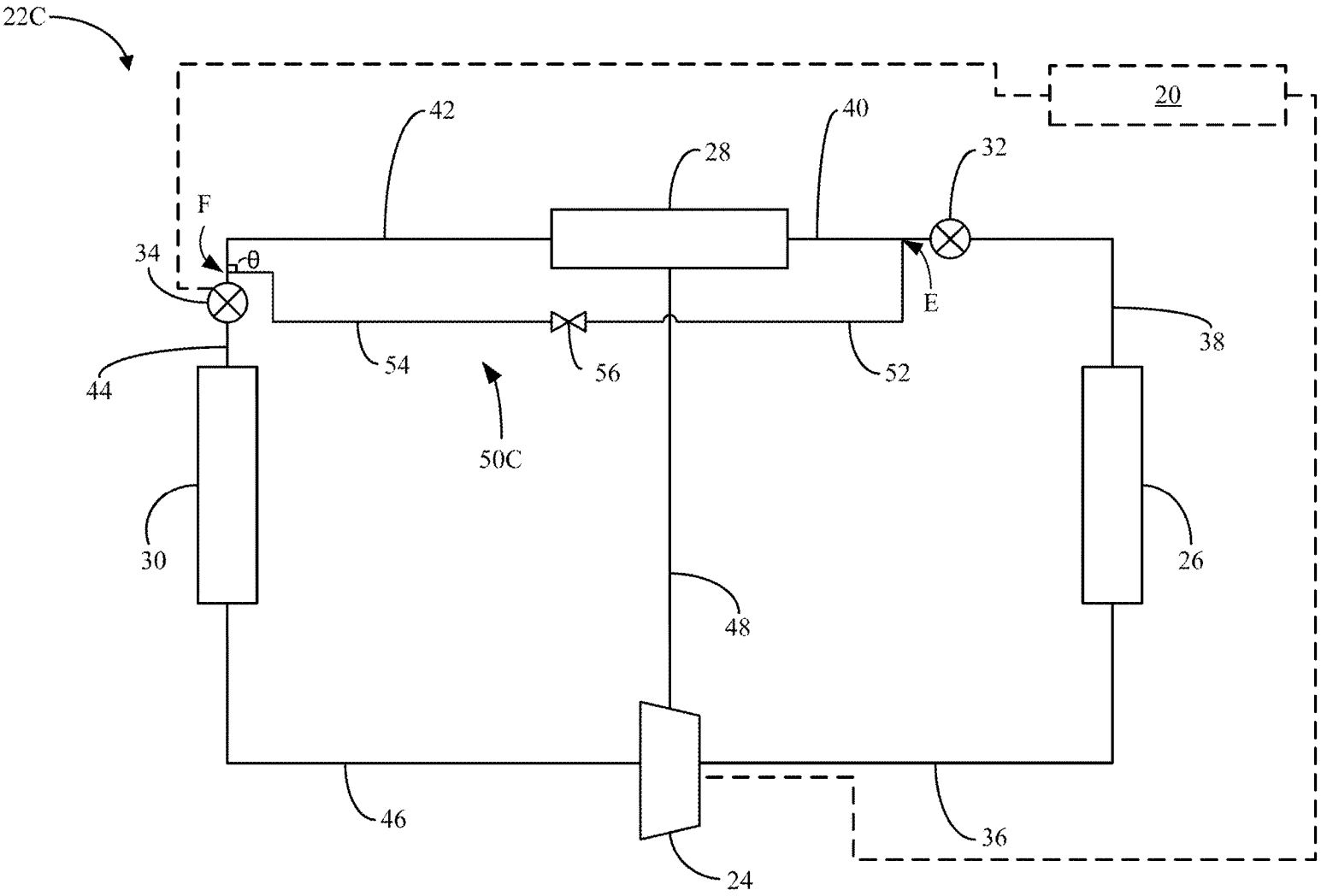
FIG. 4 is a schematic diagram of a refrigerant circuit, according to an embodiment.

The refrigerant circuit 22C in FIG. 4 includes a bypass segment 50C. In the illustrated embodiment, the bypass segment 50C includes conduits 52, 54 and the flow control device 56. The bypass segment 50C can generally operate similarly to the bypass segments 50A-50B. The bypass segment 50C is configured to receive working fluid at a different location E than the locations A and C of bypass segments 50A-50B. The bypass segment 50C is fluidly connected to the conduit 40 at a location F, such that when the working fluid exits the expansion device 32 and flows to the economizer 28 via the conduit 40, a portion of the working fluid may be diverted into the bypass segment 50C via the conduit 52. A state of the flow control device 56 can determine whether the working fluid flows to the conduit 54 and is joined with the conduit 42.

In the illustrated embodiment, the vortex is created in the flow of the working fluid at the location F which is prior to the working fluid flowing into the expansion device 34. It will be appreciated that the vortical flow may be induced at a different location than location F illustrated in the schematic diagram of FIG. 4. For example, the joinder of the conduits 54 and 42 can be relatively nearer to the expansion device 34 in an embodiment, relatively nearer to the economizer 28, or at or about equidistant from the expansion device 34 and the economizer 28. The location F of the joinder of the conduits 54 and 42 can be selected to provide a particular pressure drop in the working fluid prior to the working fluid reaching the expansion device 34. Similarly, the location E at which the conduit 52 is joined with the conduit 40 can be varied. For example, an inlet to the conduit 52 can be relatively nearer to the expansion device 32, relatively nearer to the economizer 28, or at or about equidistant from the expansion device 32 and the economizer 28.

In operation, the bypass segment 50C can advantageously cause a relatively lower static pressure within the working fluid flow and cause a portion of the working fluid to transition to a gaseous form prior to the pressure drop induced by the expansion device 34. In an embodiment, the bypass segment 50C can result in, for example, a wider range of conditions at which the refrigerant circuit 22C (and accordingly the chiller unit (e.g., chiller unit 10 of FIG. 1)) can operate because of the additional pressure drop. In an embodiment, this can enable the refrigerant circuit 22C to maintain a pressure differential between the condenser 26 and the evaporator 30 when in an operating condition in which water temperature of the process fluid in the condenser 26 are relatively lower.

Figure 5:
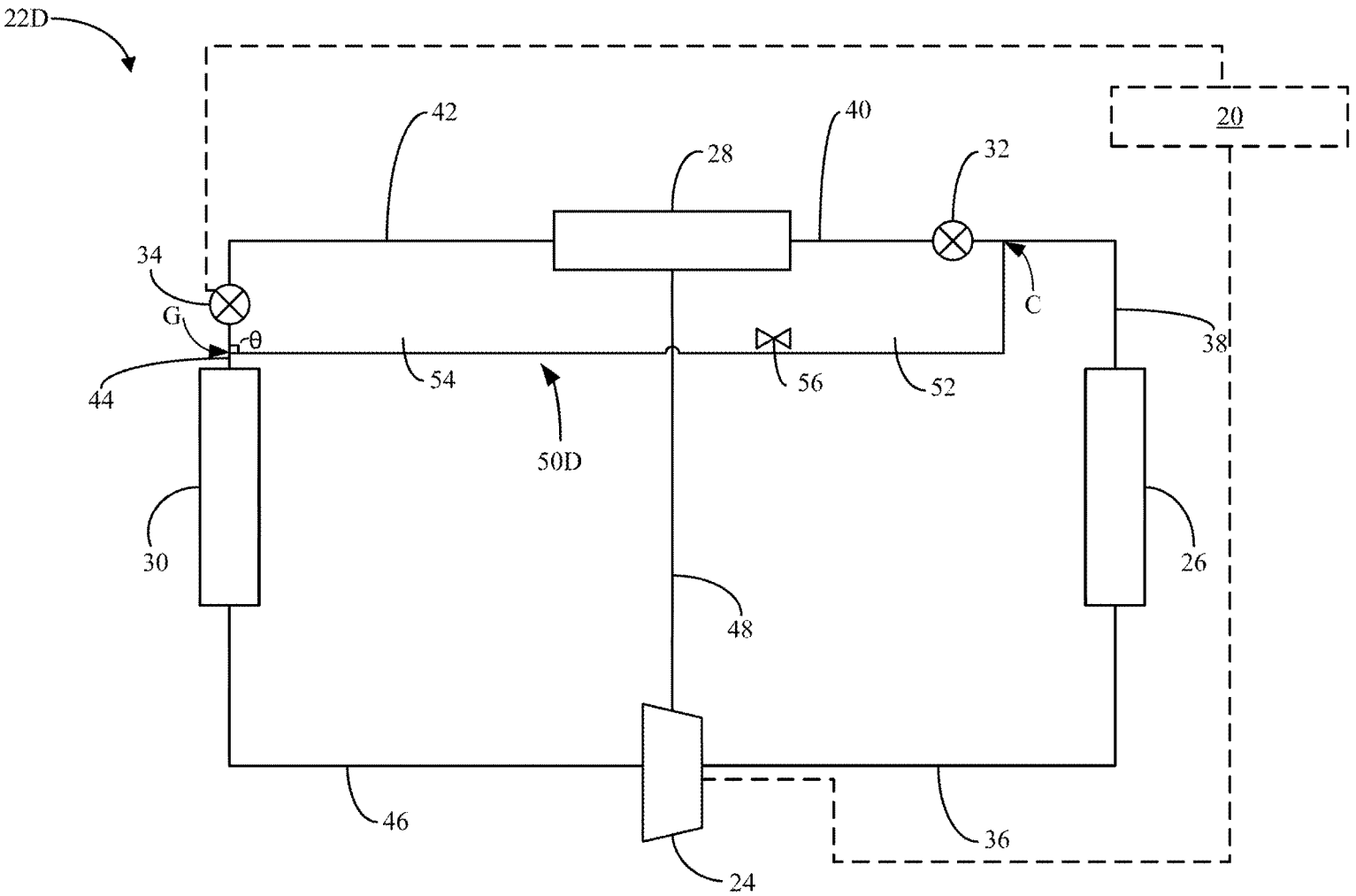
FIG. 5 is a schematic diagram of a refrigerant circuit, according to an embodiment.

The refrigerant circuit 22D in FIG. 5 includes a bypass segment 50D. In the illustrated embodiment, the bypass segment 50D includes conduits 52, 54 and the flow control device 56. The bypass segment 50D can generally operate similarly to the bypass segments 50A-50C. The bypass segment 50D is configured to receive working fluid at a location C that is similar to the bypass segment 50B. The bypass segment 50D is rejoined with the refrigerant circuit 22D at a location G that is different than the locations B, D, and F of the bypass segments 50A-50C. The bypass segment 50D is fluidly connected to the conduit 38 at the location C, such that when the working fluid exits the condenser 26 and flows to the expansion device 32 via the conduit 38, a portion of the working fluid may be diverted into the bypass segment 50D via the conduit 52. The conduit 52 is rejoined with the refrigerant circuit 22D at conduit 44 at the location G which is between the expansion device 34 and an inlet to the evaporator 30. A state of the flow control device 56 can determine whether the working fluid flows to the conduit 54 and is joined with the conduit 44.

In the illustrated embodiment, the vortex is created in the flow of the working fluid at the location G before the working fluid flows into the evaporator 30. It will be appreciated that the vortical flow may be induced at a different location than the location G illustrated in the schematic diagram of FIG. 5. For example, the joinder of the conduits 54 and 44 can be relatively nearer to the expansion device 34, relatively nearer to the evaporator 30, or at or about equidistant from the expansion device 34 and the evaporator 30. The location G of the joinder of the conduits 54 and 44 can be selected to provide a particular pressure drop in the working fluid prior to the working fluid reaching the evaporator 30. Similarly, a location at which the conduit 52 is joined with the conduit 38 can be varied. For example, an inlet to the conduit 52 can be relatively nearer to the expansion device 32, relatively nearer to the condenser 26, or at or about equidistant from the expansion device 32 and the condenser 26.

In operation, the bypass segment 50D can advantageously cause additional working fluid to be provided to the evaporator 30. In an embodiment, the bypass segment 50D can result in, for example, a wider range of conditions at which the refrigerant circuit 22D (and accordingly the chiller unit (e.g., chiller unit 10 of FIG. 1)) can operate. In an embodiment, this can enable the refrigerant circuit 22D to maintain a pressure differential between the condenser 26 and the evaporator 30 when in an operating condition in which water temperature of the process fluid in the condenser 26 are relatively lower.

The bypass segments 50A-50D can be included in the refrigerant circuits 22A-22D at a time of initial setup of the refrigerant circuits 22A-22D, according to an embodiment. In another embodiment, the bypass segments 50A-50D can be added to a refrigerant circuit that does not include a bypass segment. That is, the bypass segments 50A-50D can be retrofit into a refrigerant circuit that was initially setup without the bypass segments 50A-50D. In another embodiment, the bypass segments 50A-50D can be included in the initial setup of the refrigerant circuit, but disabled. In such an embodiment, the bypass segments 50A-50D could be enabled at a later time.

It will be appreciated that one or more of the embodiments described with reference to FIGS. 2-5 can be combined in a single refrigerant circuit.

Figure 6:
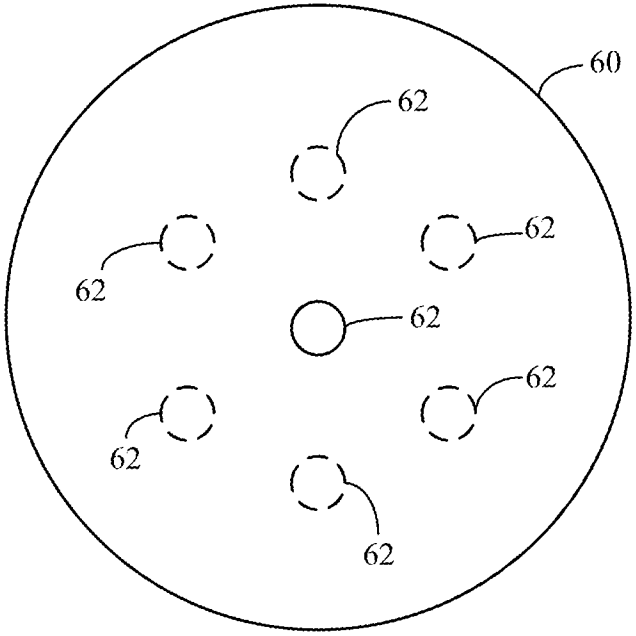
FIG. 6 is a schematic diagram of an orifice plate, according to an embodiment.

FIG. 6 is a schematic diagram of an orifice plate 60, according to an embodiment. The orifice plate 60 can be used for the expansion devices 32, 34 as shown and described above with respect to FIGS. 2-5. The orifice plate 60 includes a plurality of apertures 62. The orifice plate 60 can include one or more apertures 62, according to an embodiment. In the illustrated embodiment, the central aperture 62 is illustrated in solid black lines, while the other apertures 62 are illustrated in dashed lines. The apertures 62 which are illustrated in dashed lines may be optional, according to an embodiment. It will be appreciated that the size and location of the apertures 62 is not intended to be limiting. The orifice plate 60 generally includes one or more of the apertures 62. The orifice plate 60 can be included in the refrigerant circuits 22A-22D as described above at locations, for example, as indicated by the expansion devices 32, 34. It will be appreciated that although a single orifice plate 60 is illustrated, a plurality of orifice plates 60 (e.g., two orifice plates 60, etc.) can be included in the refrigerant circuits 22A-22D in one of the locations of the expansion devices 32, 34. Further, the plurality of orifice plates 60 can include one or more apertures 62 when included in a double orifice plate arrangement.

Aspects:

It is to be appreciated that any one of aspects 1-8 can be combined with any one of aspects 9-14 and/or 15-20. Any one of aspects 9-14 can be combined with any one of aspects 15-20.

Aspect 1. A refrigerant circuit, comprising:

a compressor, a condenser, a first expansion device, an economizer, a second expansion device, and an evaporator fluidly connected;

a working fluid that flows through the refrigerant circuit; and a bypass segment of the refrigerant circuit fluidly connected to the refrigerant circuit, wherein a portion of the working fluid is provided from the refrigerant circuit to the bypass segment, the portion of the working fluid being provided from a location in the refrigerant circuit disposed between the condenser and the evaporator with respect to flow of the working fluid, flowing through the bypass segment in a flow enabled state, and being provided to a location in the refrigerant circuit disposed between the economizer and the evaporator with respect to flow of the working fluid, wherein a vortical flow is induced at the location in the refrigerant circuit disposed between the economizer and the evaporator based on merging of the working fluid and the portion of the working fluid.

Aspect 2. The refrigerant circuit according to aspect 1, wherein the first and second expansion devices are orifice plate type devices that include a single plate or a plurality of plates, the single plate or the plurality of plates including one or more apertures.

Aspect 3. The refrigerant circuit according to any one of aspects 1-2, wherein the bypass segment further comprises a flow control device that controls a flow of working fluid through the bypass segment.

Aspect 4. The refrigerant circuit according to any one of aspects 1-3, wherein the portion of the working fluid is provided from a location in the refrigerant circuit disposed between the condenser and the first expansion device with respect to flow of the working fluid.

Aspect 5. The refrigerant circuit according to any one of aspects 1-4, wherein the portion of the working fluid is provided from a location in the refrigerant circuit disposed between the first expansion device and the economizer with respect to flow of the working fluid.

Aspect 6. The refrigerant circuit according to any one of aspects 1-5, wherein the portion of the working fluid is provided from a location in the refrigerant circuit disposed between the economizer and the second expansion device with respect to flow of the working fluid.

Aspect 7. The refrigerant circuit according to any one of aspects 1-6, wherein the portion of the working fluid is provided to a location in the refrigerant circuit disposed between the economizer and the second expansion device with respect to flow of the working fluid.

Aspect 8. The refrigerant circuit according to any one of aspects 1-7, wherein the portion of the working fluid is provided to a location in the refrigerant circuit disposed between the second expansion device and the evaporator with respect to flow of the working fluid.

Aspect 9. A chiller unit for a heating, ventilation, air conditioning, and refrigeration (HVACR) system, comprising:

a refrigerant circuit, comprising:

a compressor, a condenser, a first expansion device, an economizer, a second expansion device, and an evaporator fluidly connected;

a working fluid that flows through the refrigerant circuit; and a bypass segment of the refrigerant circuit fluidly connected to the refrigerant circuit, wherein a portion of the working fluid is provided from the refrigerant circuit to the bypass segment, the portion of the working fluid being provided from a location in the refrigerant circuit disposed between the condenser and the evaporator with respect to flow of the working fluid, flowing through the bypass segment in a flow enabled state, and being provided to a location in the refrigerant circuit disposed between the economizer and the evaporator with respect to flow of the working fluid, wherein a vortical flow is induced at the location in the refrigerant circuit disposed between the economizer and the evaporator.

Aspect 10. The chiller unit according to aspect 9, wherein the portion of the working fluid is provided from a location in the refrigerant circuit disposed between the condenser and the first expansion device with respect to flow of the working fluid.

Aspect 11. The chiller unit according to any one of aspects 9-10, wherein the portion of the working fluid is provided from a location in the refrigerant circuit disposed between the first expansion device and the economizer with respect to flow of the working fluid.

Aspect 12. The chiller unit according to any one of aspects 9-11, wherein the portion of the working fluid is provided from a location in the refrigerant circuit disposed between the economizer and the second expansion device with respect to flow of the working fluid.

Aspect 13. The chiller unit according to any one of aspects 9-12, wherein the portion of the working fluid is provided to a location in the refrigerant circuit disposed between the economizer and the second expansion device with respect to flow of the working fluid.

Aspect 14. The chiller unit according to any one of aspects 9-13, wherein the portion of the working fluid is provided to the location in the refrigerant circuit disposed between the second expansion device and the evaporator with respect to flow of the working fluid.

Aspect 15. A method, comprising:

compressing a working fluid with a compressor;

directing the working fluid from the compressor to a condenser;

directing the working fluid from the condenser to an evaporator;

diverting a portion of the working fluid from the condenser to a bypass conduit, the bypass conduit having an inlet disposed between the condenser and the evaporator, and the bypass conduit having an outlet disposed between the condenser and the evaporator, the outlet being relatively closer to the evaporator than the inlet; and inducing a vortical flow in the working fluid at the outlet of the bypass conduit by rejoining the portion of the working fluid with the working fluid from the condenser to the evaporator.

Aspect 16. The method according to aspect 15, wherein the bypass conduit includes a flow control device, the method further comprises selectively enabling or disabling flow of the working fluid through the bypass conduit by the flow control device.

Aspect 17. The method according to any one of aspects 15-16, wherein the working fluid is directed from the condenser to an economizer, and from the economizer to the evaporator.

Aspect 18. The method according to aspect 17, wherein the inlet is disposed between the condenser and the economizer, and the outlet is disposed between the economizer and the evaporator.

Aspect 19. The method according to aspect 17, wherein the inlet is disposed between the economizer and the evaporator, and the outlet is disposed between the economizer and the evaporator.

Aspect 20. The method according to any one of aspects 17-19, wherein the outlet is disposed between the economizer and an expansion device, the expansion device being disposed between the economizer and the evaporator.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A refrigerant circuit, comprising:

a compressor, a condenser, a first expansion device, an economizer, a second expansion device, and an evaporator fluidly connected within a closed circuit;

a working fluid that flows through the refrigerant circuit, the working fluid flowing in series through the condenser, the first expansion device, the economizer, the second expansion device, and the evaporator; and a bypass segment of the refrigerant circuit fluidly connected to the refrigerant circuit, wherein a portion of the working fluid is provided from the refrigerant circuit to the bypass segment, the portion of the working fluid being provided from a location in the refrigerant circuit disposed between the condenser and the evaporator with respect to flow of the working fluid, flowing through the bypass segment in a flow enabled state, and being provided to a location in the refrigerant circuit disposed between the economizer and the evaporator with respect to flow of the working fluid, wherein a conduit of the bypass segment has a diameter that is smaller than a diameter of a conduit between the economizer and the evaporator such that a flowrate of the working fluid through the conduit of the bypass segment is different than a flowrate of the working fluid through the conduit between the economizer and the evaporator, wherein a vortical flow is induced at the location in the refrigerant circuit disposed between the economizer and the evaporator based on merging of the working fluid and the portion of the working fluid.

2. The refrigerant circuit according to claim 1, wherein the first and second expansion devices are orifice plate type devices that include a single plate or a plurality of plates, the single plate or the plurality of plates including one or more apertures.

3. The refrigerant circuit according to claim 1, wherein the bypass segment further comprises a flow control device that controls a flow of working fluid through the bypass segment, the flow control device being disposed on the conduit of the bypass segment.

4. The refrigerant circuit according to claim 1, wherein the portion of the working fluid is provided from one of:

a location in the refrigerant circuit disposed between the condenser and the first expansion device with respect to flow of the working fluid, a location in the refrigerant circuit disposed between the first expansion device and the economizer with respect to flow of the working fluid, or a location in the refrigerant circuit disposed between the economizer and the second expansion device with respect to flow of the working fluid.

5. The refrigerant circuit according to claim 1, wherein the portion of the working fluid is provided to one of:

a location in the refrigerant circuit disposed between the economizer and the second expansion device with respect to flow of the working fluid, or a location in the refrigerant circuit disposed between the second expansion device and the evaporator with respect to flow of the working fluid.

6. The refrigerant circuit according to claim 1, wherein an angle other than 90° is formed between the conduit of the bypass segment and the conduit between the economizer and the evaporator.

7. A chiller unit for a heating, ventilation, air conditioning, and refrigeration (HVACR) system, comprising:

a refrigerant circuit, comprising:

a compressor, a condenser, a first expansion device, an economizer, a second expansion device, and an evaporator fluidly connected within a closed circuit;

a working fluid that flows through the refrigerant circuit, the working fluid flowing in series through the condenser, the first expansion device, the economizer, the second expansion device, and the evaporator; and a bypass segment of the refrigerant circuit fluidly connected to the refrigerant circuit, wherein a portion of the working fluid is provided from the refrigerant circuit to the bypass segment, the portion of the working fluid being provided from a location in the refrigerant circuit disposed between the condenser and the evaporator with respect to flow of the working fluid, flowing through the bypass segment in a flow enabled state, and being provided to a location in the refrigerant circuit disposed between the economizer and the evaporator with respect to flow of the working fluid, wherein a conduit of the bypass segment has a diameter that is smaller than a diameter of a conduit between the economizer and the evaporator such that a flowrate of the working fluid through the conduit of the bypass segment is different than a flowrate of the working fluid through the conduit between the economizer and the evaporator, and wherein the conduit of the bypass segment is joined with a conduit between the economizer and the evaporator, an angle other than 90° being formed between the conduit of the bypass segment and the conduit between the economizer and the evaporator, wherein a vortical flow is induced at the location in the refrigerant circuit disposed between the economizer and the evaporator.

8. The chiller unit according to claim 7, wherein the portion of the working fluid is provided from a location in the refrigerant circuit disposed between the condenser and the first expansion device with respect to flow of the working fluid.

9. The chiller unit according to claim 7, wherein the portion of the working fluid is provided from a location in the refrigerant circuit disposed between the first expansion device and the economizer with respect to flow of the working fluid.

10. The chiller unit according to claim 7, wherein the portion of the working fluid is provided from a location in the refrigerant circuit disposed between the economizer and the second expansion device with respect to flow of the working fluid.

11. The chiller unit according to claim 7, wherein the portion of the working fluid is provided to a location in the refrigerant circuit disposed between the economizer and the second expansion device with respect to flow of the working fluid.

12. The chiller unit according to claim 7, wherein the portion of the working fluid is provided to the location in the refrigerant circuit disposed between the second expansion device and the evaporator with respect to flow of the working fluid.

13. A method, comprising:

compressing a working fluid with a compressor;

directing the working fluid in series from the compressor to a condenser and directing the working fluid in series from the condenser to an evaporator within a closed circuit;

diverting a portion of the working fluid from the condenser to a bypass conduit, the bypass conduit having an inlet and an outlet each respectively disposed between the condenser and the evaporator downstream of the condenser and upstream of the evaporator, the outlet being relatively closer to the evaporator than the inlet, wherein the bypass conduit has a diameter that is smaller than a diameter of a conduit between the condenser and the evaporator such that a flowrate of the working fluid through the bypass conduit is different than a flowrate of a non-diverted portion of the working fluid flowing through the conduit between the condenser and the evaporator; and inducing a vortical flow in the working fluid at the outlet of the bypass conduit by rejoining the portion of the working fluid with the non-diverted portion of the working fluid as the non-diverted portion of the working fluid is flowing from the condenser to the evaporator.

14. The method according to claim 13, wherein the bypass conduit includes a flow control device disposed on the bypass conduit, the method further comprises selectively enabling or disabling flow of the working fluid through the bypass conduit by the flow control device.

15. The method according to claim 13, wherein the working fluid is directed from the condenser to an economizer and from the economizer to the evaporator.

16. The method according to claim 15, wherein the inlet is disposed between the condenser and the economizer, and the outlet is disposed between the economizer and the evaporator.

17. The method according to claim 15, wherein the inlet is disposed between the economizer and the evaporator, and the outlet is disposed between the economizer and the evaporator.

18. The method according to claim 15, wherein the outlet is disposed between the economizer and an expansion device, the expansion device being disposed between the economizer and the evaporator.

19. The method according to claim 15, wherein the portion of the working fluid is rejoined with the non-diverted portion of the working fluid at an angle other than 90°.

* * * * *